United States Patent [19]

Baus

[11] Patent Number: 4,789,069

[45] Date of Patent: Dec. 6, 1988

[54] TOWEL-HOLDER

[76] Inventor: Heinz G. Baus, Wartbodenstrasse 35, CH-3626 Hünibach-Thun, Switzerland

[21] Appl. No.: 114,853

[22] Filed: Oct. 30, 1987

[30] Foreign Application Priority Data

Nov. 11, 1986 [DE] Fed. Rep. of Germany ..... 3638490
Dec. 17, 1986 [DE] Fed. Rep. of Germany ..... 3643033

[51] Int. Cl.[4] ..... A47F 5/08
[52] U.S. Cl. ..... 211/105.3; 211/96; 211/123
[58] Field of Search ..... 211/105.3, 105.2, 123, 211/1.3, 96, 94, 104; 108/29

[56] References Cited

U.S. PATENT DOCUMENTS

| | | | |
|---|---|---|---|
| 1,061,988 | 5/1913 | Currie | 211/105.3 X |
| 2,355,835 | 8/1944 | Whalen | 211/94 |
| 2,825,469 | 3/1958 | Watkins et al. | 211/105.3 |
| 3,239,071 | 3/1966 | Sormanni | 211/119 |
| 4,212,402 | 7/1980 | Kelly et al. | 211/105.3 |

FOREIGN PATENT DOCUMENTS

| | | |
|---|---|---|
| 2300534 | 9/1976 | France . |
| 2413515 | 7/1979 | France . |
| 2010672 | 7/1979 | United Kingdom . |

*Primary Examiner*—Robert W. Gibson, Jr.
*Attorney, Agent, or Firm*—Foley & Lardner, Schwartz, Jeffery, Schwaab, Mack, Blumenthal & Evans

[57] ABSTRACT

A towel-holder, more particularly for a shower- or bathtub-partition, comprises a supporting bar which is adapted to be secured, substantially horizontally, by connecting parts, to a wall and, furthermore, an extension bar which is arranged to be displaceable in a substantially horizontal plane in relation to the said supporting bar. The invention is intended to improve, at low cost, handling and to reduce the danger of damage to the holder or injury to the user. To this end the extension bar consists of at least two parts connected together by a hinge. With the supporting bar secured horizontally, the axis of the hinge runs substantially vertically and, in view of a locking device, the front part of the extension bar can be set at specific angular positions in relation to the rear part and to the supporting bar.

16 Claims, 5 Drawing Sheets

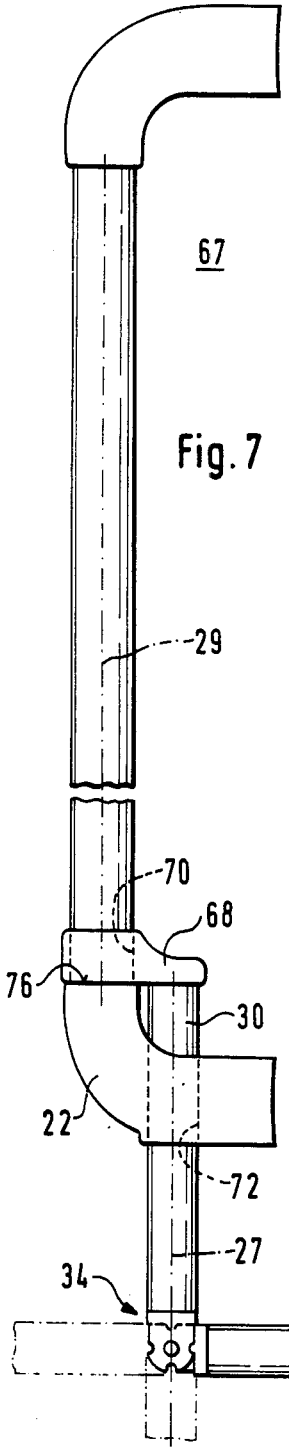
Fig. 7
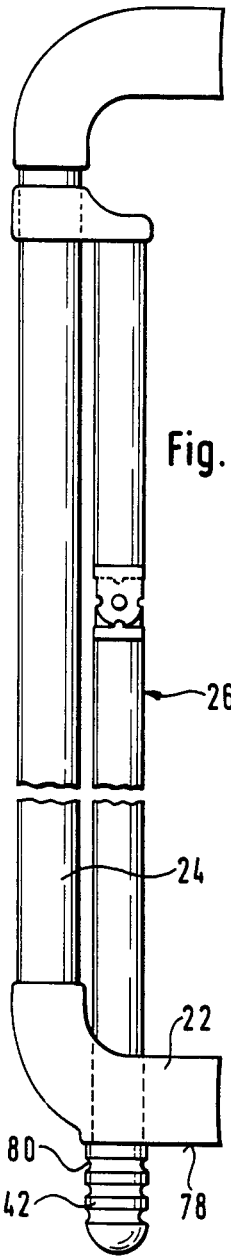
Fig. 8
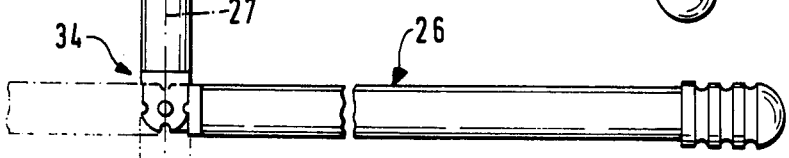

TOWEL-HOLDER

BACKGROUND OF THE INVENTION

1. Field of the Invention

The present invention relates to a towel-holder, more particularly for a shower- or bathtub-partition.

The towel-holder of the present invention is of the type comprising a supporting bar which is adapted to be secured, by means of connecting parts and in a vertical plane of attachment, to a wall, with the longitudinal axis running horizontally, and comprising an extension bar, the axis of which is aligned with the longitudinal axis of the supporting bar and is arranged axially displaceably in relation thereto.

2. Description of the Invention

German Pat. No. 35 26 730 discloses a towel-holder of this kind. The extension bar is in one piece and may, if necessary be pushed into and pulled out of the supporting bar. In the pulled-out position, there is the danger of a person "catching himself" on the bar, in which case the towel-holder may be damaged or the person may even be injured, all the more so if a towel-holder of this kind is installed in a bath- or shower-room where there is often not too much room for a person to move.

OBJECTS OF THE INVENTION

It is an object of the invention to develop a towel-holder, at little cost, in such a manner as to ensure safe handling and to reduce the danger of damaging the towel-holder or even injuring a person. The towel-holder is also to be stable, to be functionally reliable, and to be of simple design.

SUMMARY OF THE INVENTION

In order to accomplish this object, according to the present invention, there is provided a towel-holder, comprising a supporting bar having a longitudinal axis running horizontally and adapted to be secured by means of connecting parts and in a vertical plane of attachment to a wall, and an extension bar having an axis which is aligned with the longitudinal axis of the supporting bar and which is arranged axially displaceably in relation to said supporting bar, wherein:

the extension bar comprises at least two parts, a front part and a rear part, connected together by means of a hinge, said hinge having an axis which is arranged substantially in parallel with said plane of attachment and at right angles to the longitudinal axis of the supporting bar.

The towel-holder according to the invention is of simple design and the problems indicated at the beginning hereof, arising when the extension bar is fully or only partly extended, are overcome by simple means. The hinge makes it a simple matter to pivot the front part of the extension bar. With the towel-holder secured to a stationary part of the shower-partition, the front part of the extension bar, may easily be pivoted, if necessary, in front of the entry-area, making it easy for the user to grasp a towel hanging upon the extension bar.

Preferably, the hinge is provided with locking means in order to provide a specific angular setting between the front and rear parts of the extension bar. More particularly, settings spaced at 90° are provided, to allow the front part of the extension bar to be adjusted for any particular application. The towel-holder may also be secured to one wall of the room, so that a towel, or an article of clothing, hanging on the front part swung away from the wall, may very easily be grasped.

The two parts of the extension bar are preferably in the form of hollow sections so that the hinge, with appropriately designed lugs, can be pushed into the internal cavity and secured therein, to which end lugs of the two halves of the hinge are preferably equipped with protrusions, or the like, projecting slightly from the outer surfaces. This makes it easy to insert the lugs into cavities of the extension bar, a press-fit being assured by deformation of the said protrusions. This also eliminates the need for very close tolerances and this has a favourable effect upon production costs.

In one preferred embodiment, the extension bar is arranged displaceably within the hollow supporting bar, the external contour and/or dimensions of the hinge being at the most equal to the cross-section of the internal cavity of the supporting bar. This design of the two-piece extension bar, coaxial with the supporting bar, makes it possible to insert the extension bar into the supporting bar and to withdraw it therefrom. If the two parts of the extension bar are telescoped into the supporting bar, all that remains visible is a grip which the user can grasp in order to pull the two parts of the extension bar out of the supporting bar when necessary.

According to another preferred embodiment of the invention, noted for a particularly stable configuration of the hinge, the extension bar is arranged in parallel with the supporting bar and comprises, at the free end of the rear part, a guide-part engaging at least partly around the supporting bar. The extension bar is located in a plane parallel with the supporting bar and, looking horizontally towards the latter, behind it. The connecting part has an opening which is staggered in relation to the supporting bar, in which the extension bar is guided and is displaceable along the axis thereof.

BRIEF DESCRIPTION OF THE DRAWINGS

Preferred embodiments of the invention are explained hereinafter in greater detail, as examples without limitative manner, with reference to the attached drawings, wherein:

FIG. 7 is a view of the towel-holder in a direction VII according to FIG. 6;

FIG. 8 is a view according to FIG. 7, but with the extension bar pushed back;

DESCRIPTION OF AN EXEMPLARY EMBODIMENT

Figure 1:
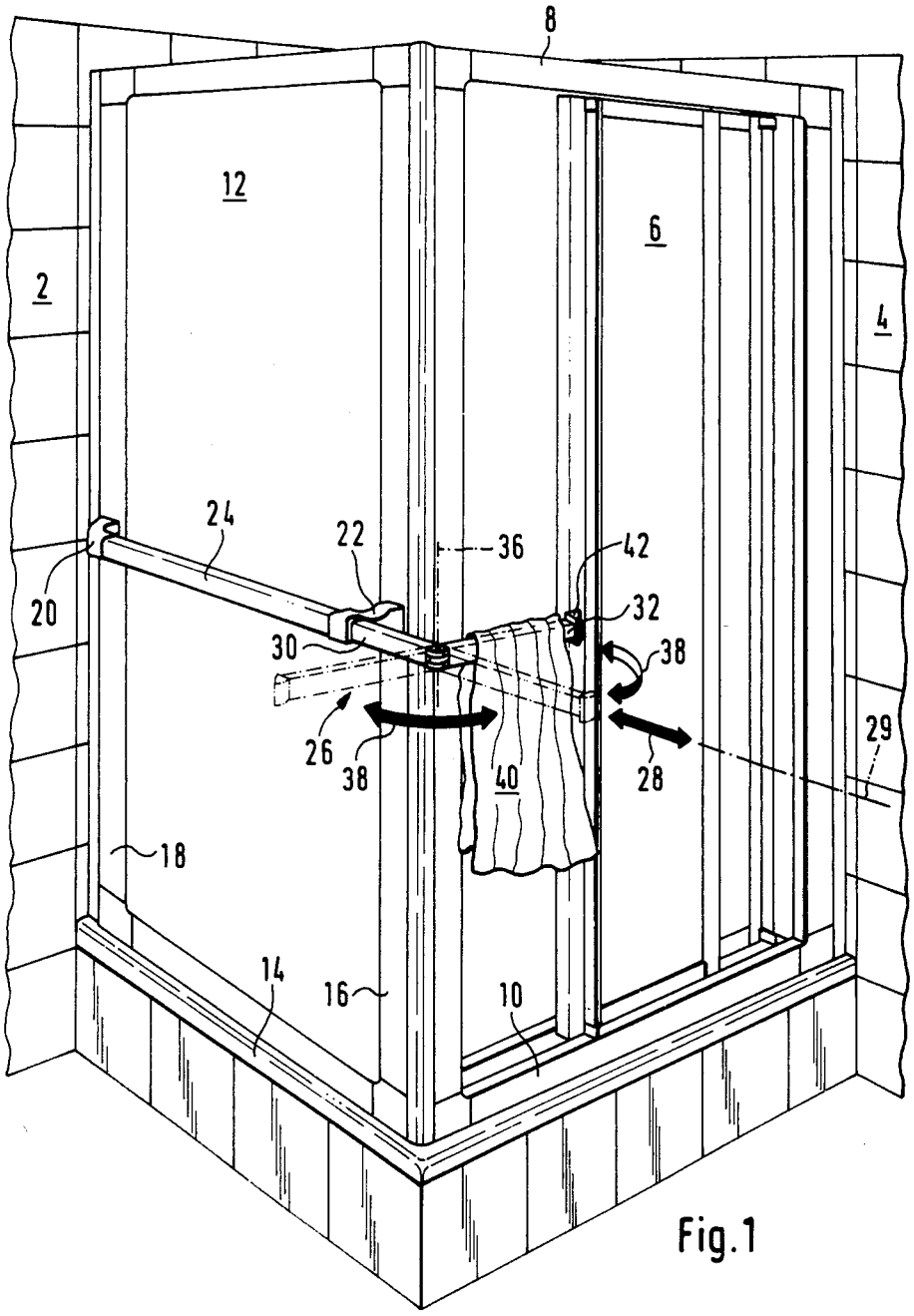
FIG. 1 is a diagrammatical view of a towel-holder secured to a stationary lateral part of a shower partition.

FIG. 1 shows a shower-partition arranged around a shower-tub, not shown, in the corner between two room-walls 2 and 4. This partition comprises, in the entry-area, displaceably arranged doors 6 which are suspended from, and guided by, profiled rails 8, 10 of a frame. The partition also comprises a stationary lateral wall 12 which is set upon upper wall 14 of the tube and is attached to a room-wall 2 in a manner which will not be explained herein. Lateral wall 12 contains two vertical profiled rails 16, 18 to which connecting parts 20, 22 of the towel-holder are secured. The external surfaces of profiled rails 16, 18 define the vertical attachment surface of the towel-holder.

The towel-holder comprises a horizontal supporting bar 24 which is hollow and is connected to the connecting parts 20, 22. The supporting bar 24 is a hollow section in the free interior of which an extension bar 26 is arranged displaceably in the direction of a longitudinal axis 29 indicated by double arrow 28. The extension bar 26 consists of two parts 30,32 which are hinged together by means of a hinge 34, the axis 36 of which is arranged vertically. The axis 36 runs parallel with the plane of attachment and substantially at right angles to the longitudinal axis 29. The front part 32 of the extension bar 26 is pivoted through an angle of 90°, about the hinge-axis 36, in relation to the rear part 30 and the supporting bar 24. As may be seen, the front part 32 may be pivoted, according to double arrow 38, into positions shown in dotted lines which are defined by locking means. When the front part 32 is in the position shown, it is in front of the entrance to the shower, so that a towel 40, hanging upon the front part 32, can easily be grasped by a user after he has showered. When parts 30, 32 are in a straight line, as defined by the locking means according to the invention, there is no difficulty in sliding them into supporting bar 24. As a result of the division of the extension bar, and of the ability of front part 32 to pivot, there is no danger of damage to the holder or injury to a person. The external dimensions of hinge 34 correspond substantially to the external dimensions of parts 30, 32 and they can therefore be introduced therewith into the supporting bar 24. Arranged at the front end of part 32 is a grip 42 which, when the parts are telescoped into each other, is located in the vicinity of the connecting part 22 where it can be grasped by a user in order to pull the extension bar out.

Figure 2:
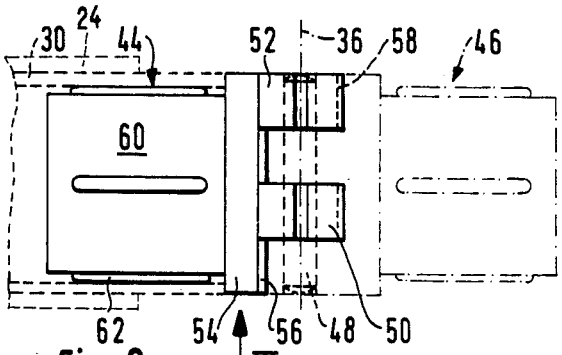
FIG. 2 is a side elevation of the hinge, to an enlarged scale.

FIG. 2 shows, to an enlarged scale, hinge 34, identical elements 44, 46 of which are adapted to pivot in relation to each other about a pin 48. For the sake of clarity, element 46 is shown here in dotted lines and the following comments on element 44 apply equally to element 46. Element 44 comprises two hinge-parts 50, 52 spaced axially from each other and having central passage 53 for the accommodation of the hinge-pin 48. The hinge-parts 50, 52 are arranged in a central part 54 containing locking catches 56 pointing towards pin 48. The hinge-parts 50,52 are provided with correspondingly designed locking grooves 58.

On the other side of central part 54, the element 44 comprises an approximately rectangular lug 66, the outer surface of which carries longitudinal protrusions 62. Element 44 is pushed, with protrusions 66, into the free interior of hollow part 30 of the extension bar 26. It is essential that hinge-part 44 be a press-fit in the said extension bar 26, adequate deformability being assured by protrusions 62 and production tolerances being functionally compensated for.

Figure 3:
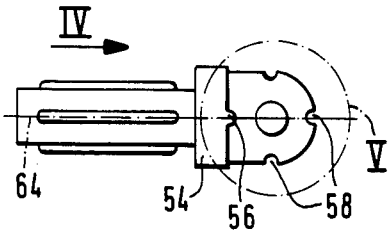
FIG. 3 is a view of the hinge in direction III according to FIG. 2.

FIG. 3 is a view of element 44, but three locking grooves 59 may now be seen quite clearly in hinge-part 50. These grooves are arranged at 90° to each other, the central groove being arranged in longitudinal plane 64 in which the longitudinal axis of the supporting bar 24 lies. This central groove therefore sets the two parts of the extension bar 26 in a straight line, to enable them to be inserted into the supporting bar 24. Locking catch 56, on the central part 54, also lies in longitudinal plane 64. If the corresponding locking catch in the other element is also engaged in central locking groove 58 of element 54, the lugs of the two hinge-elements are in alignment with each other.

Figure 4:
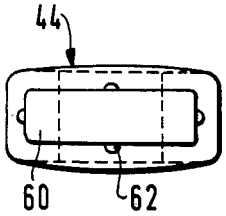
FIG. 4 is a view of the hinge in direction IV according to FIG. 3.

FIG. 4 shows element 44 in a view of lug 60, the four protrusions 62, arranged in the longitudinal direction, being clearly visible. During insertion into the interior of the extension-bar part, these protrusions 62 are compressed. This ensures a firm seat, even with relatively large manufacturing tolerances.

Figure 5:
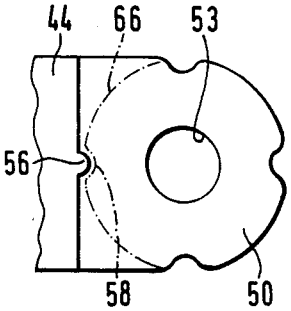
FIG. 5 shows detail V according to FIG. 3, to an enlarged scale.

FIG. 5 shows hinge-part 50 to an enlarged scale, the corresponding hinge-part of the other element being indicated by dotted line 66. Locking grooves 58 are visible, with locking catch 56 of element 44 engaging in locking groove 58. The previously defined angular positions are easily obtained.

Figure 6:
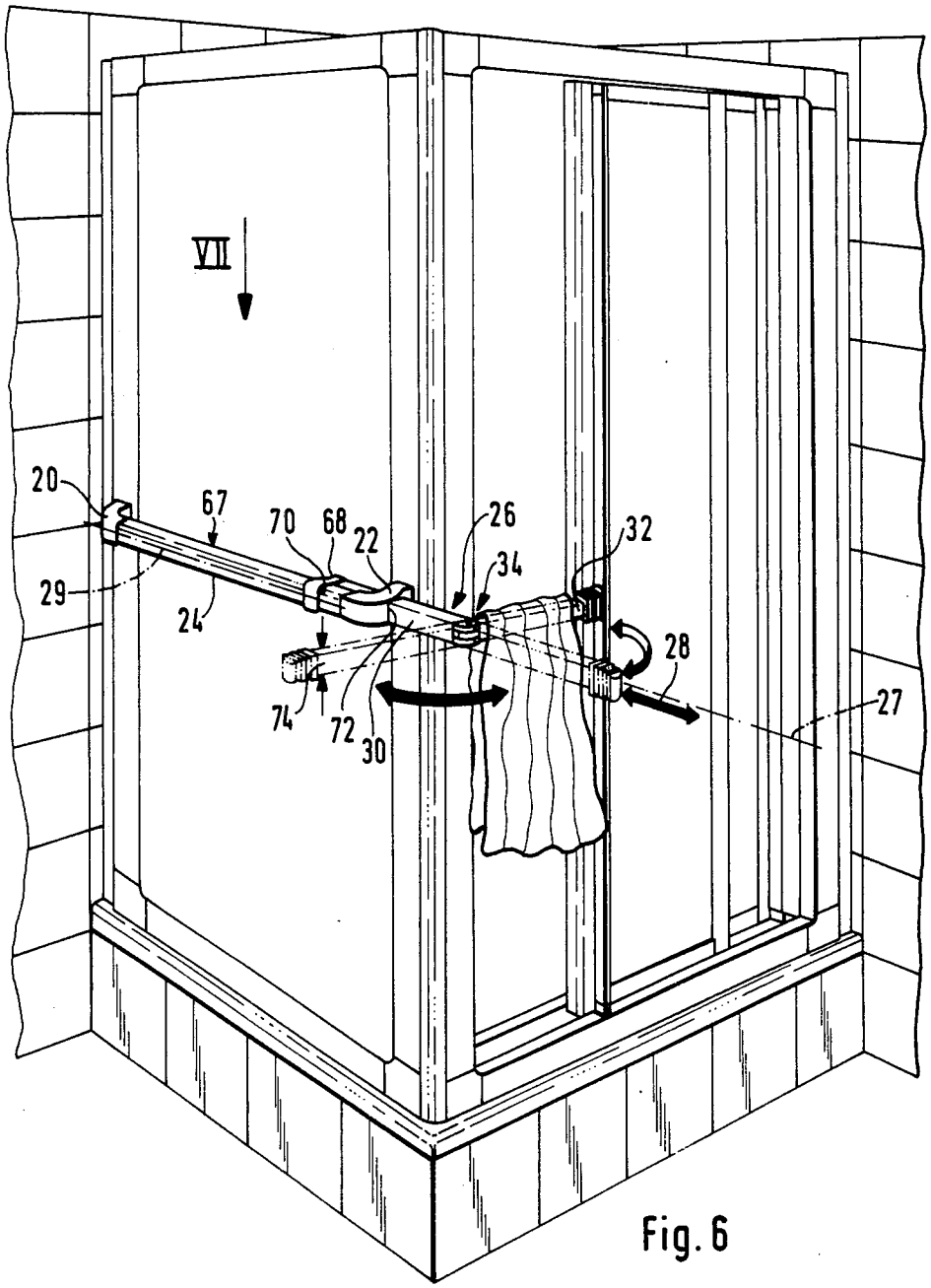
FIG. 6 is a view according to FIG. 1 of an embodiment in which the extension bar is arranged displaceably behind the supporting bar.

FIG. 6 illustrates a particularly stable example of embodiment in which parts 30, 32, and hinge 34, are arranged in parallel with, and behind supporting bar 24. Axis 27 of rear part 30 of the extension bar runs parallel with longitudinal axis 29 of supporting bar 24. Arranged at the rear end of part 30 is a guide part 68 which engages at least partly around the said supporting bar 24. The guide-part 68 contains a bearing opening 70 through which the supporting bar 24 passes. The contour of the bearing opening 70 matches the outside contour of the supporting bar 24 and is of rectangular cross-section. This is a simple way of preventing rotation and the extension bar 26 is located, looking towards the shower-partition and the supporting bar 24, at least partly in the free space 67 behind it. The front connecting part 22 also has an opening 72 matching the outside contour of extension bar 26. The parts 30, 32 and hinge 34, the outside contour of which is no larger than these parts, may be pushed through opening 72. This opening lies in the horizontal plane offset behind the supporting bar 24. The height 74 of the extension bar 26 is substantially equal to the vertical height of the supporting bar 24. The external dimensions of the hinge 34 may be independent of the size of the interior of the supporting bar 24 and the stablility of the hinge 36 is therefore considerably improved as compared with the example of embodiment explained at the beginning hereof. Great functional reliability is assured at low cost and damage, especially to the hinge, is reliably avoided.

FIG. 7 shows quite clearly the guide-part 68 connected to the rear part 30. The rear guide 76 of connecting part 22 forms a stop for the guide-part 68 and this is an inexpensive way of preventing the extension bar 26 from being inadvertently pulled out. The guide-part 68 is arranged, corresponding to the above-mentioned lugs, in the interior end of part 30 and is a press-fit therein.

FIG. 8 shows the towel-holder with extension bar 26 retracted. Grip 42 projects from front edge 78 of connecting part 22 and may easily be grasped and held by a user. The grip is a few centimeters in length and, in a simple manner, peripheral grooves therein substantially improve grasping and handling of the bar.

Figure 9:
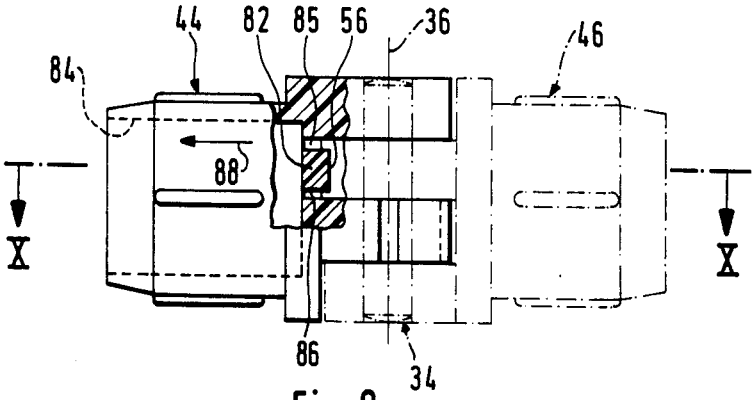
FIG. 9 is a side elevation view of the hinge of the embodiment according to FIG. 6.

FIG. 9 shows a view of hinge 34 corresponding to that in FIG. 2 and to the same scale. The hinge is cut in the vicinity of locking catch 56 which is arranged upon a lever 82. Elements 44 and 46 are hollow and possess internal recesses 84. Located at the bottom of recess 84 are two gaps 85, 86 extending to axis 36 of the hinge and a third gap 87 which may be seen in FIG. 10. Lever 82 thus formed, and consisting of a resilient plastic, allows locking catch 56 to deviate in the direction of arrow 88 when element 46 is rotated about hinge-axis 36. This substantially reduces the danger of damage arising from the use of excessive force by the user. On the other hand, satisfactory locking is assured in the angular settings predetermined by the locking grooves.

Figure 10:
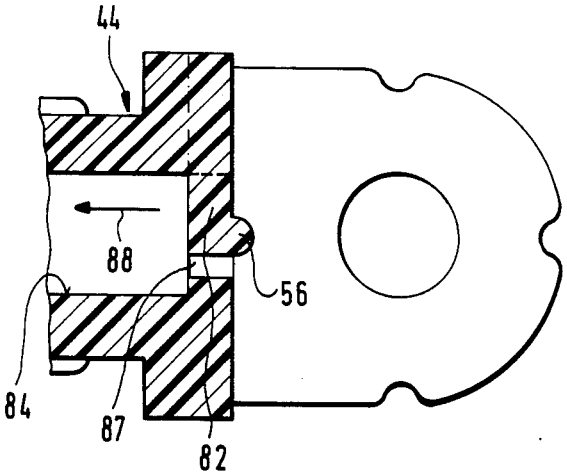
FIG. 10 is a cross-section view along the line AB of FIG. 9.

FIG. 10 is a cross-section through element 44 along the line A-B in FIG. 9. Recess 84 and gap 87 may be seen quite clearly. Locking catch 56 arranged on lever 82 allows, in a simple manner, resilient deviation of the locking catch rearwardly, in the direction of arrow 88.

I claim:

1. A towel-holder, comprising a supporting bar having a longitudinal axis running horizontally and adapted to be secured by means of connecting parts and in a vertical plane of attachment to a wall, and an extension bar having an axis which is aligned with the longitudinal axis of the supporting bar and which is arranged axially displaceably in relation to said supporting bar, wherein:

the extension bar comprises at least two parts, a front part and a rear part, connected together by means of a hinge, said front part and said rear part having the same outer contour as each other and each being formed from a hollow shaped rail having a rectangular cross sectional configuration, said hinge having an axis which is arranged substantially in parallel with said plane of attachment and at right angles to the longitudinal axis of the supporting bar.

2. A towel holder comprising a supporting bar having a longitudinal axis running horizontally and adapted to be secured by means of connecting parts and in a vertical plane of attachment to a wall, and an extension bar having an axis which is aligned with the longitudinal axis of the supporting bar and which is arranged axially displaceably in relation to said supporting bar, wherein the extension bar comprises at least two parts, a front part and a rear part, connected together by means of a hinge, said hinge having an axis which is arranged substantially in parallel with said plane of attachment and at right angles to the longitudinal axis of the supporting bar, and said hinge consists of two elements each having a lug, each lug being arranged inside one hollow part of said extension bar.

3. A towel-holder comprising a supporting bar having a longitudinal axis running horizontally and adapted to be secured by means of connecting parts and in a vertical plane of attachment to a wall, and an extension bar having an axis which is aligned with the longitudinal axis of the supporting bar and which is arranged axially displaceably in relation to said supporting bar, wherein the extension bar comprises at least two parts, a front part and a rear part, connected together by means of a hinge, said hinge having an axis which is arranged substantially in parallel with said plane of attachment and at right angles to the longitudinal axis of the supporting bar, and said hinge consists of two elements, each having a lug, each lug being pressed into one part of said extension bar.

4. A towel-holder according to claim 2, wherein said elements of the hinge comprise hinge-parts, each having a central bore, said elements being adapted to mesh into each other like combs, with a common hinge-pin passing through said central bores of said elements.

5. A towel-holder according to claim 4, wherein said elements of the hinge are identical.

6. A towel-holder according to claim 4, wherein each of said elements of the hinge comprises a locking catch with which is associated a locking groove of the other element.

7. A towel-holder according to claim 6, wherein the front part of the extension bar is longer than the rear part, the length of the said front part being greater than that of the said rear part by a factor of at least 2.

8. A towel-holder according to claim 7, wherein said factor is 3.

9. A towel-holder according to claim 7, wherein said factor is 4.

10. A towel-holder according to claim 1, wherein said supporting bar has a hollow interior and wherein the external contour of the hinge is, at the most, equal to the cross-section of said hollow interior of said supporting bar, said extension bar being mounted in the interior of said supporting bar in such a manner as to be displaceable in the direction of the longitudinal axis of said supporting bar and being adapted to be pulled out of one end of said supporting bar.

11. A towel-holder comprising a supporting bar having a longitudinal axis running horizontally and adapted to be secured by means of connecting parts and in a vertical plane of attachment to a wall, and an extension bar having a axis which is aligned with the longitudinal axis of the supporting bar and which is arranged axially displaceably in relation to said supporting bar, wherein the extension bar comprises at least two parts, a front part and a rear part connected together by means of a hinge, said hinge having an axis which is arranged substantially in parallel with said plane of attachment and at right angles to the longitudinal axis of the supporting bar, and said extension bar is arranged in parallel with and behind said supporting bar, a guide part comprising a bearing opening engaging at least partly around the supporting bar, said guide part being arranged at the end of the rear part of said extension bar, and wherein one of said connecting parts comprises an opening in which said extension bar is displacably mounted.

12. A towel-holder according to claim 11, wherein said extension bar is arranged in a free space between said two connecting parts which are formed as angle pieces.

13. A towel-holder according to claim 11, wherein said one connecting part has a rear edge which is formed as a stop surface for said guide-part thus preventing the inadvertent pulling out of said extension bar beyond said connecting part.

14. A towel-holder according to claim 13, wherein said bearing opening has a rectangular cross-section in order to prevent said bearing-part from rotating about the longitudinal axis of the supporting bar.

15. A towel-holder according to claim 11, wherein each of said elements of the hinge comprises a locking catch with which is associated a locking groove of the other element, each locking catch being arranged to be resiliently mobile upon a lever.

16. A towel-holder according to claim 15, wherein each of said hinge-elements comprises a recess at the bottom of which is arranged the lever which is partly surrounded by gaps which pass through the bottom towards said axis of said hinge.

* * * * *